US008678609B2

(12) United States Patent
Lau

(10) Patent No.: US 8,678,609 B2
(45) Date of Patent: Mar. 25, 2014

(54) PORTABLE LIGHT ASSEMBLY WITH SPOT LIGHT ACCESSORY

(76) Inventor: Chi-Hung Fermi Lau, Kowloon (HK)

( * ) Notice: Subject to any disclaimer, the term of this patent is extended or adjusted under 35 U.S.C. 154(b) by 386 days.

(21) Appl. No.: 12/658,532

(22) Filed: Feb. 10, 2010

(65) Prior Publication Data

US 2010/0284177 A1 Nov. 11, 2010

Related U.S. Application Data

(63) Continuation-in-part of application No. 12/387,699, filed on May 5, 2009, now Pat. No. 8,083,368.

(51) Int. Cl.
*F21L 4/00* (2006.01)

(52) U.S. Cl.
USPC ..... 362/208; 362/190; 362/457; 362/427

(58) Field of Classification Search
USPC ..... 362/157, 196, 208, 457, 190–191, 427
See application file for complete search history.

(56) References Cited

U.S. PATENT DOCUMENTS 4,345,304 A * 8/1982 Penney et al. ..... 362/183
5,755,319 A * 5/1998 Szymanski et al. ..... 200/43.02
5,867,868 A * 2/1999 Ward ..... 16/422
6,033,082 A * 3/2000 Lin ..... 362/120
6,056,414 A * 5/2000 Krieger ..... 362/184
6,260,985 B1 * 7/2001 Zeller ..... 362/202
6,669,353 B2 * 12/2003 Kung ..... 362/191
7,172,312 B2 * 2/2007 Chen ..... 362/202
7,287,873 B2 * 10/2007 Galli ..... 362/158
7,434,969 B2 * 10/2008 Ford et al. ..... 362/382
7,635,208 B2 * 12/2009 Hedrick ..... 362/399
2002/0036902 A1 * 3/2002 Lynch et al. ..... 362/166
2006/0176688 A1 * 8/2006 Yuen ..... 362/184
2008/0239711 A1 * 10/2008 Seok ..... 362/157
2011/0047850 A1 * 3/2011 Rievley et al. ..... 42/72

* cited by examiner

*Primary Examiner* — Robert May
(74) *Attorney, Agent, or Firm* — Raymond Y. Chan; David and Raymond Patent Firm

(57) ABSTRACT

A spot light includes a universal body, a light arrangement and a spot light accessory. The universal body includes a main body having a receiving compartment, and a light body, having a light cavity and a light opening, frontwardly and integrally extending from the main body. The light arrangement is supported by the universal body for generating illumination at the light opening. The spot light accessory includes a plurality of accessory elements selectively and detachably coupling with the universal body to transform the universal body from one configuration to another configuration so as to provide varieties of functional utilizations of the universal body.

9 Claims, 19 Drawing Sheets

PORTABLE LIGHT ASSEMBLY WITH SPOT LIGHT ACCESSORY

CROSS REFERENCE OF RELATED APPLICATION

This is a Continuation-In-Part application of a U.S. patent application having an application Ser. No. 12/387,699 and a filing date of May 5, 2009 now U.S. Pat. No. 8,083,368.

BACKGROUND OF THE PRESENT INVENTION

1. Field of Invention

The present invention relates to a spot light, and more particular to a spot light comprises a spot light accessory having a plurality of accessory elements selectively and detachably coupling with the universal body to transform the universal body from one configuration to another configuration while being cost effective.

2. Description of Related Arts

A flash light is a common tool in our daily life to provide light in the dark or additional light in specific situation. Nowadays, it not only uses for people to see clearer, but also becomes a type of decoration. Except for the brightness of the flash light, the consumer puts more emphasis on their function whether or not the flash lights are convenient for the consumer to use.

A conventional flash light is usually a portable electric spotlight which emits light from a light bowl. Because people prefer greater choice of flash light, they are more and more different kinds of flash lights sold on the market. People usually can choose different appearances and functions to match their preference. Therefore, the user does not need to worry about that they cannot find the right flash light they like. However, most of the flash lights sold on the market are only focus on the some specific usages; for example, when people want to find a flash light having a very intensive light, the volume and weight of the flash light are usually big. Also, it is troublesome for a people to place the flash light on the ground. On the other hand, when people try to find a flash light having a very flexible structure easy for people to assemble and disassemble, the intensity of the light are usually smaller. Moreover, the flash light may made of some light material such that it is not durable enough for a long period of use.

Furthermore, no matter which type of the flash light is used, there exist some problems on how to support the flash light on the ground while there is no stand or support on the ground or no one can help. In general, the flash light is usually support by some people or standing on the stand. In order words, like camera, the flash light requires a stand to support on its bottom to secure its position. On the other hand, if the volume and weight of the flash light is large, some specific appliance is needed to assist people to hand carry or moving.

It is necessary to develop a flash light to solve the problem as mentioned before to keep the flash light convenient and easier to use.

SUMMARY OF THE PRESENT INVENTION

A main object of the present invention is to provide a spot light, wherein the spot light comprises a spot light accessory having a plurality of accessory elements selectively and detachably coupling with the universal body to transform the universal body from one configuration to another configuration so as to provide varieties of functional utilizations of the universal body. In other words, the type of spot light, the hand carry method, and even the supporting method of the floor stand are flexible depends on the customers needs. Moreover, the commercial value of the spot light dramatically increases owing to providing varieties of functional utilizations for different needs.

Another object of the present invention is to provide a spot light, wherein the spot light comprises a U-shaped handle member coupling at a top side of the main body such that the universal body with the handle member form a handheld spot light for allowing a user to carry the spot light.

Another object of the present invention is to provide a spot light, wherein the front leg frame and the rear leg frame are pivotally coupling at front and rear portions of the main body at a bottom side thereof respectively, such that the universal body with the front and rear leg frames forms a floor stand spot light.

Another object of the present invention is to provide a spot light, wherein the illumination unit within the light body is replaceable such that the user is able to choose the type of the illumination unit they preferred to meet different need in different situation.

Another object of the present invention is to provide a spot light, wherein the structure of the spot light is simple therefore making the apparatus easy to assemble and disassemble.

Accordingly, in order to accomplish the above objects, the present invention provides a spot light, comprising:

a universal body comprising a main body having a receiving compartment, and a light body, having a light cavity and a light opening, frontwardly and integrally extending from the main body;

a light arrangement supported by the universal body for generating illumination at the light opening; and a spot light accessory comprising a plurality of accessory elements selectively and detachably coupling with the universal body to transform the universal body from one configuration to another configuration so as to provide varieties of functional utilizations of the universal body.

These and other objectives, features, and advantages of the present invention will become apparent from the following detailed description, the accompanying drawings, and the appended claims.

DETAILED DESCRIPTION OF THE PREFERRED EMBODIMENT

Figure 1:
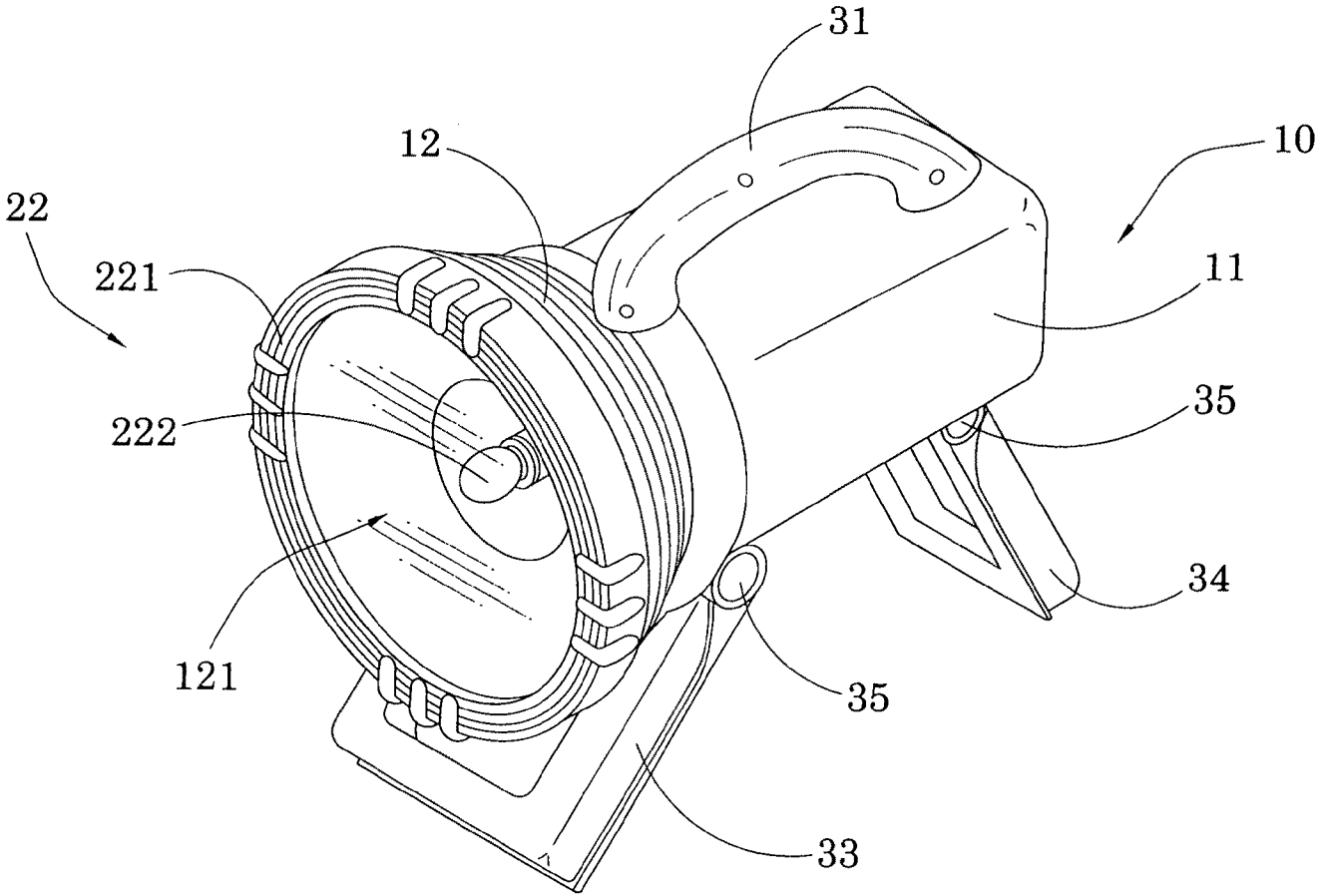
FIG. 1 is a perspective view of a spot light according to a first preferred embodiment of the present invention.
Figure 2:
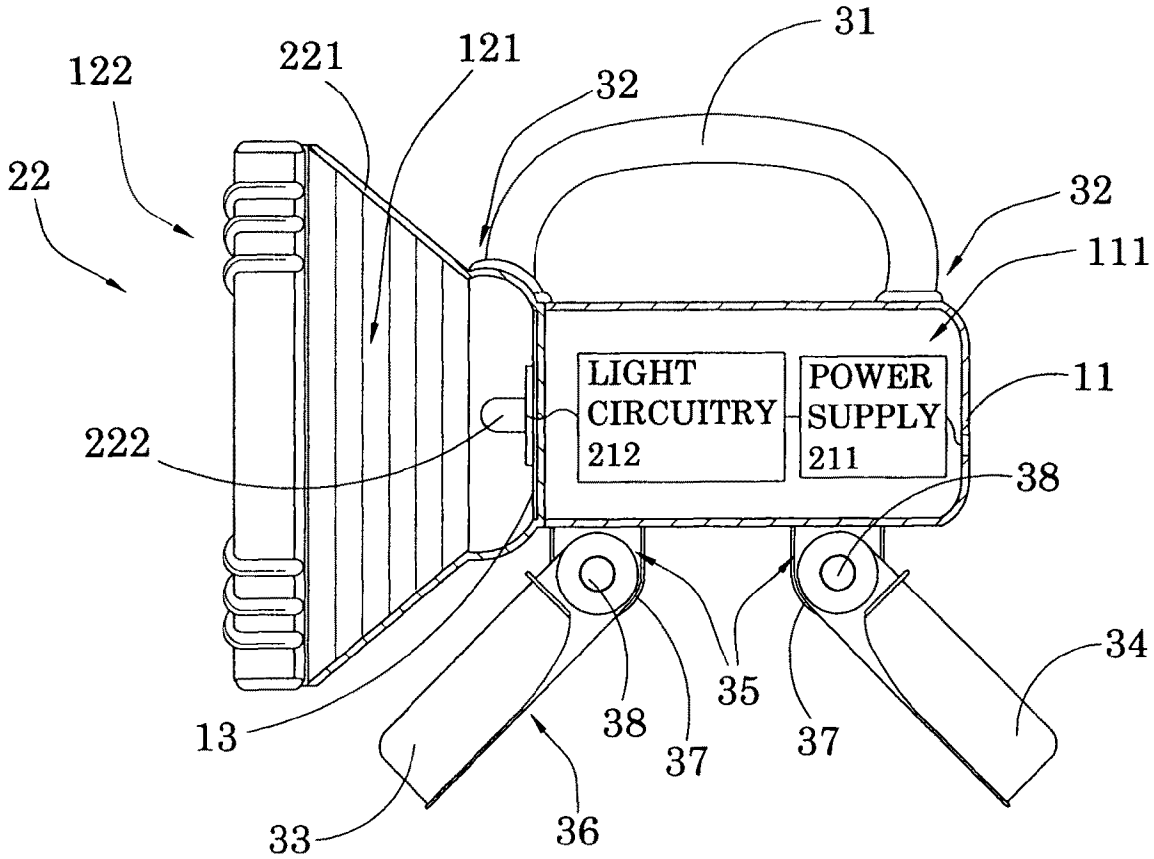
FIG. 2 is a sectional view of the spot light according to the above first preferred embodiment of the present invention.

Referring to FIGS. 1 and 2 of the drawings, a spot light according to a preferred embodiment of the present invention is illustrated, in which a spot light comprises a universal body 10, a light arrangement 20, and a spot light accessory 30.

The universal body 10 comprises a main body 11 having a receiving compartment 111, and a light body 12, having a light cavity 121 and a light opening 122, frontwardly and integrally extending from the main body 11. The universal body 10 is made of non-fragile materials such as plastic materials and is made by injection or other conventional manufacturing process to integrally form the main body 11 with the light body 12 in one piece integrated structure. The light arrangement 20 supports by the universal body 10 for generating light towards the light opening 122.

The spot light accessory 30 comprises a plurality of accessory elements selectively and detachably coupling with the universal body 10 to transform the universal body 10 from one configuration to another configuration so as to provide varieties of functional utilizations of the universal body 10. In other words, the type of spot light, the hand carry method, and even the supporting method of the floor stand are flexible depends on the customers needs. Moreover, the commercial value of the spot light dramatically increases owing to providing varieties of functional utilizations for different needs.

Figure 3:
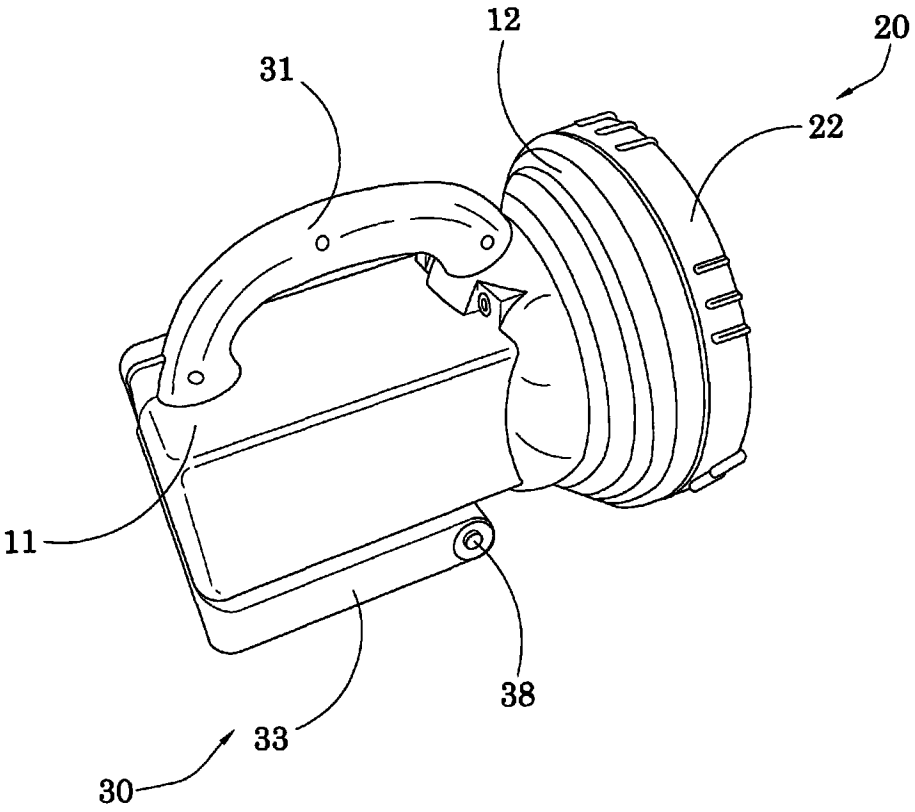
FIG. 3 is an upper view of the spot light illustrating the structure of the handle member.

Referring to FIG. 3 of the drawing, the spot light accessory 30 comprises a U-shaped handle member 31 as one of the accessory elements coupling at a top side of the main body 11 such that the universal body 10 with the handle member 31 forms a handheld spot light for allowing a user to carry the spot light. Therefore, compared with holding in the middle of the universal body, the handle member 31 provides a much easier way for people to hold and move the spot light. Moreover, the spot light accessory 30 has two spaced apart attachment slots 32 integrally pre-formed at the top side of the main body 11 to couple with two ends of the handle member 31 respectively such that the type of the handle member is replaceable to fulfill the users' need.

Figure 4A:
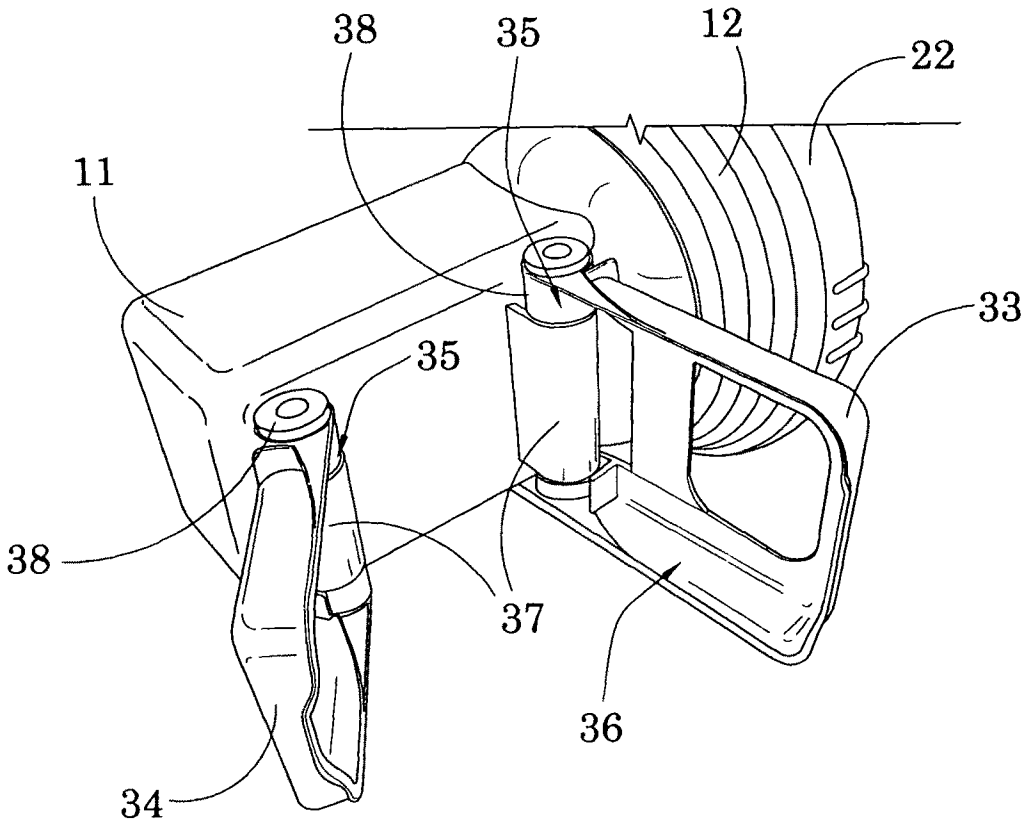
FIG. 4A and FIG. 4B are bottom view of the spot light illustrating the steps from open to close the floor stand.
Figure 4B:
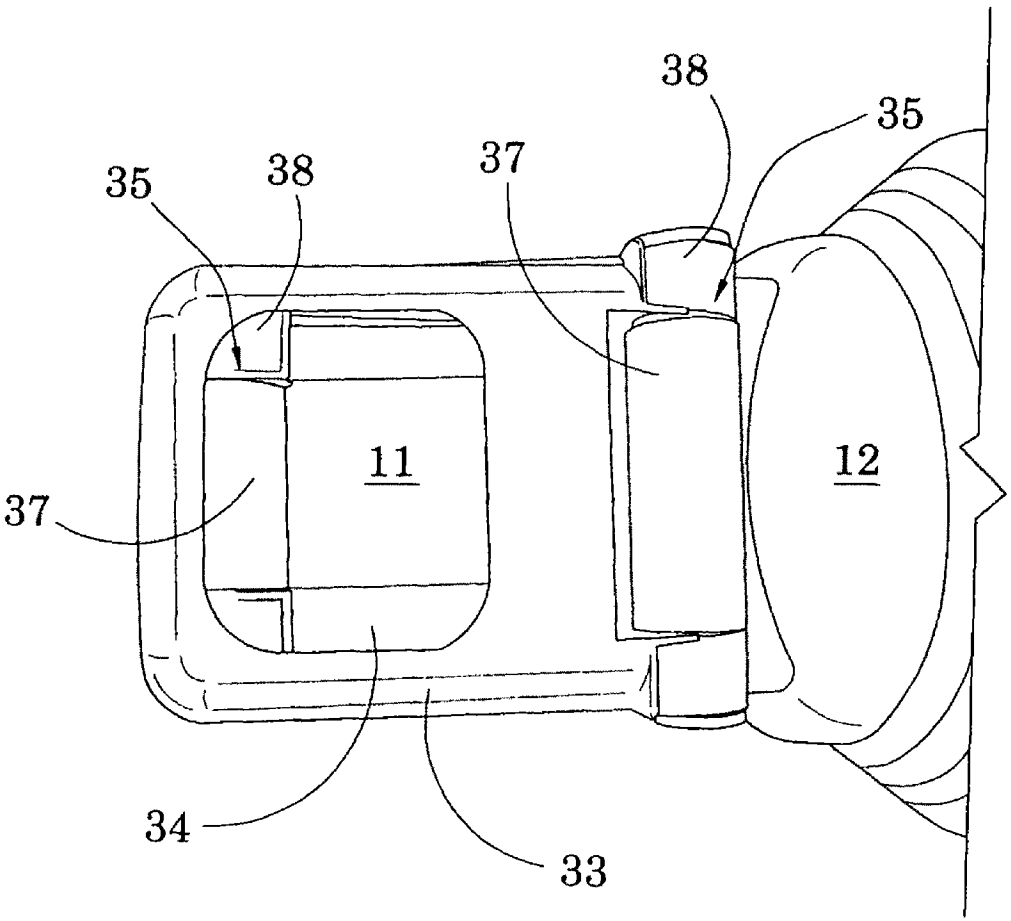
Figure 5:
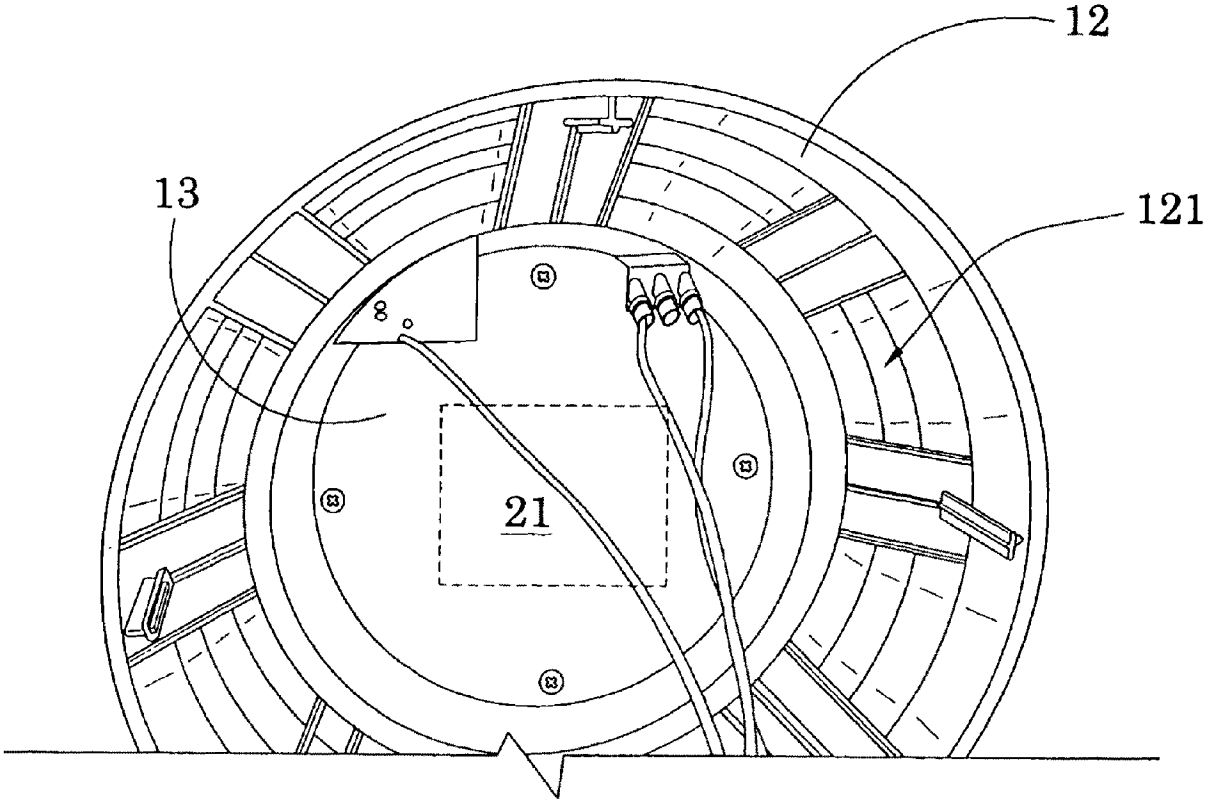
FIG. 5 is a front view of the spot light illustrating the structure of the light body.

As shown in FIGS. 4A and 4B, the spot light accessory 30 comprises a U-shaped front leg frame 33 and a U-shaped rear leg frame 34 as the accessory elements, wherein the front leg frame 33 and the rear leg frame 34 are pivotally coupling at front and rear portions of the main body 11 at a bottom side thereof respectively, such that the universal body 10 with the front and rear leg frames 33, 34 form a floor stand spot light.

The spot light accessory 30 has two spaced apart pivot slots 35 integrally and longitudinally pre-formed at the bottom side of the main body 11 to pivotally couple with the front and rear leg frames 33, 34 respectively. Accordingly, the spot light accessory 30 comprises two tubular members 37 spacedly and longitudinally provided at the bottom side of the main body 11 at front and rear portions thereof respectively, wherein the pivot slots 35 are defined within the tubular members 37 respectively. The spot light accessory 30 further comprises two axis lockers 38 for detachably locking the front and rear leg frames 33, 34 at the tubular members 37 in a pivotally movable manner. Accordingly, the axis lockers 38 are slidably and rotatably disposed within the pivot slots 35 respectively, wherein the front and rear leg frames 33, 34 are pivotally locked at the axis lockers 38 at the ends thereof such that the front and rear leg frames 33, 34 are adapted to pivotally fold between a folded position and an unfolded position.

FIGS. 4A and 4B show steps from open to close the floor stand. The front leg frame 33 has a receiving cavity 36 having a size larger than a size of the rear leg frame 34, wherein the front and rear leg frames 33, 34 are adapted to pivotally fold at the folded position at a position that when the rear leg frame 34 is pivotally and frontwardly folded on the bottom side of the main body 11, the front leg frame 33 is pivotally and rearwardly folded to enclose the rear leg frame 34 within the receiving cavity 36.

It is worth mentioning that the axis lockers 38 are adapted to limit the pivotally folding angles of the front and rear leg frames 33, 34 at the unfolded position for preventing the further pivotal movements of the front and rear leg frames 33, 34. In addition, the folding angle of each of the front and rear leg frames 33, 34 should be larger than 90° when each of the front and rear leg frames 33, 34 is pivotally folded from the bottom side of the main body 11 at the folded position to the unfolded position. Therefore, the front and rear leg frames 33, 34 are inclinedly and outwardly extended from the bottom side of the main body 11 to stably support the universal body 10 on the ground.

Moreover, the light arrangement 20 comprises an electrical unit 21 supported within the receiving compartment 111 of the main body 11 and an illumination unit 22 replaceably supported at the light cavity 121 of the light body 12 to electrically couple with the electrical unit 22. In other words, the illumination unit 22 within the light body 12 is replaceable such that the manufacturer or the user is able to choose the type of the illumination unit 22 he or she preferred to meet different need in different situation.

The illumination unit 22 comprises a reflective bowl 221 detachably coupling with the light body 12 within the light cavity 121, and an illuminator 222 supported within the reflective bowl 221 for generating the light towards the light opening 122. Accordingly, the manufacturer can manufacture different types of spot light by using the same universal body 10. For example, the manufacturer may use the conventional light bulb as the illuminator 222. Likewise, the manufacturer can replace a high intensity LED as the illuminator 222 to form a high intensity spot light for providing better illumination.

The universal body 10 further comprises a partition wall 13 supported at a position between the main body 11 and the light body 12 to separate the receiving compartment 111 from the light cavity 121. Therefore, the partition wall 13 is divided the spot light into two parts. One is within the main body 10 for providing stationary parts such as the power source and the circuit. One is within the light body 12 for providing replaceable illumination unit 22 to fulfill the customers' need. Accordingly, the electrical unit 21 is sealed and enclosed within the receiving compartment 111 by the partition wall 13, the electric unit 21 is protected and remained in usage when the illumination unit 22 is replaced.

The electrical unit 21 comprises a DC power supply 211 and a light circuitry 212 electrically coupling with the illumination unit 22, wherein the power supply 211 can be a battery compartment for replaceably receiving one or more batteries therein or a rechargeable battery.

It is worth mentioning that the sealing receiving compartment 111 reduces the chance of shortcuts and errors makes the spot light more stable and safe. Most important of all, a replaceable accessory element on the illumination unit 22, handle member 31, and the front and rear leg frame 33, 34 makes the spot light much more flexible to meet the customer needs. The conventional spot light usually only have one good feature, and can't fulfill the customers' need and is not suitable for different situation. The structure of the spot light is simple but flexible therefore making the apparatus easy to assemble and disassemble.

Figure 6A:
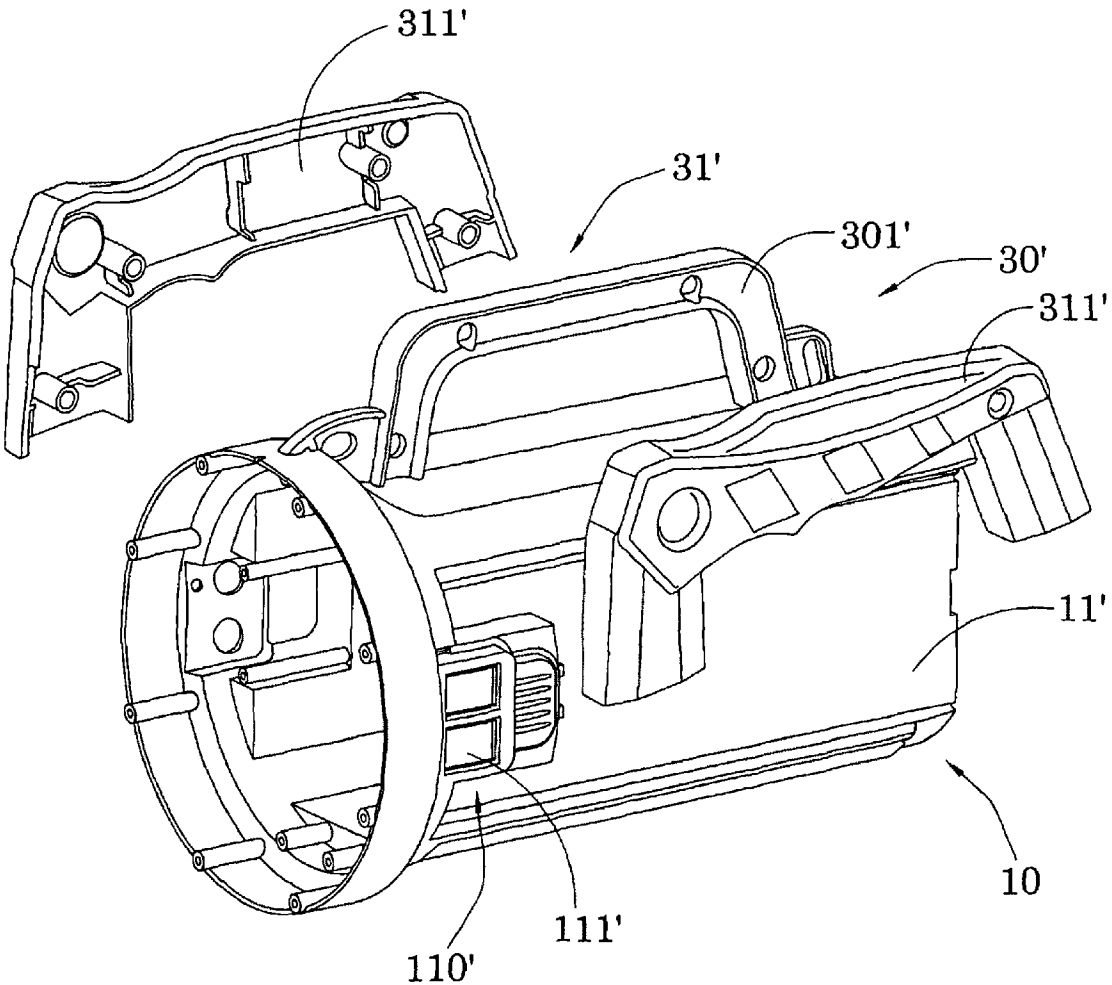
FIG. 6A and FIG. 6B illustrate a first alternative mode of the spot light according to the above preferred embodiment of the present invention.
Figure 6B:
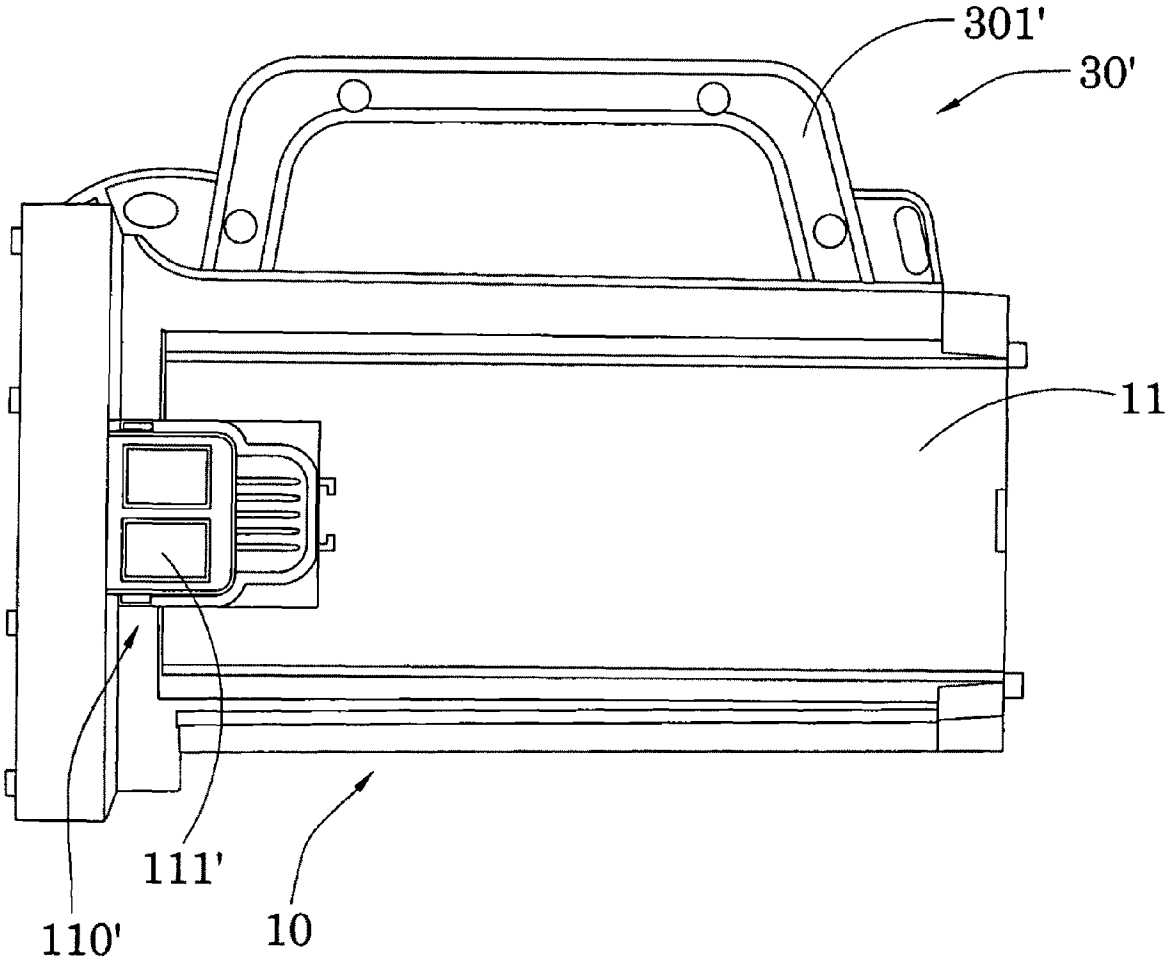

Referring to FIG. 6A and FIG. 6B of the drawings, a first alternative mode of the sport light according to the preferred embodiment of the present invention is illustrated. The first alternative mode is similar to the preferred embodiment, except the spot light accessory 30'. According to the first alternative mode, the spot light accessory comprises an attachment member 301' extended from the main body 11 for coupling with a wide variety of handle members 31' as one of the accessory elements coupled with the main body 11. The attachment member 301' can be shaped and size to correspond with the shape and size of the corresponding handle member 31'. For example, when the handle member 31', which may be manufactured as two handle frames 311', is shaped and sized to have a U-shape cross section, the attachment member 301' can also be shaped and sized to have a corresponding U-shape cross section so that the handle frames 311' are arranged to be detachably attached to two sides of the attachment member 301' for forming an optimal handle member 31' on the spot light as one of the spot light accessories 30'. Thus, the attachment member 301' has two ends integrally connected to the main body 11 for forming the U-shaped cross section.

In other words, the spot light of the present invention can provide a user with numerous sets of handle frames 311' and the user is able to freely selective which set of handle frames 311' is to be used for a particular situation. The user may then pick a set of handle frames 311' and detachably attach that set of handle frames 311' onto the attachment member 301'. After use, the user may detach the handle frames 311' from the attachment member 301' and pick another set for use in another situation. Therefore, as mentioned earlier, compared with holding in the middle of the universal body, the handle member 31' provides a much easier way for people to hold and move the spot light.

Figure 7A:
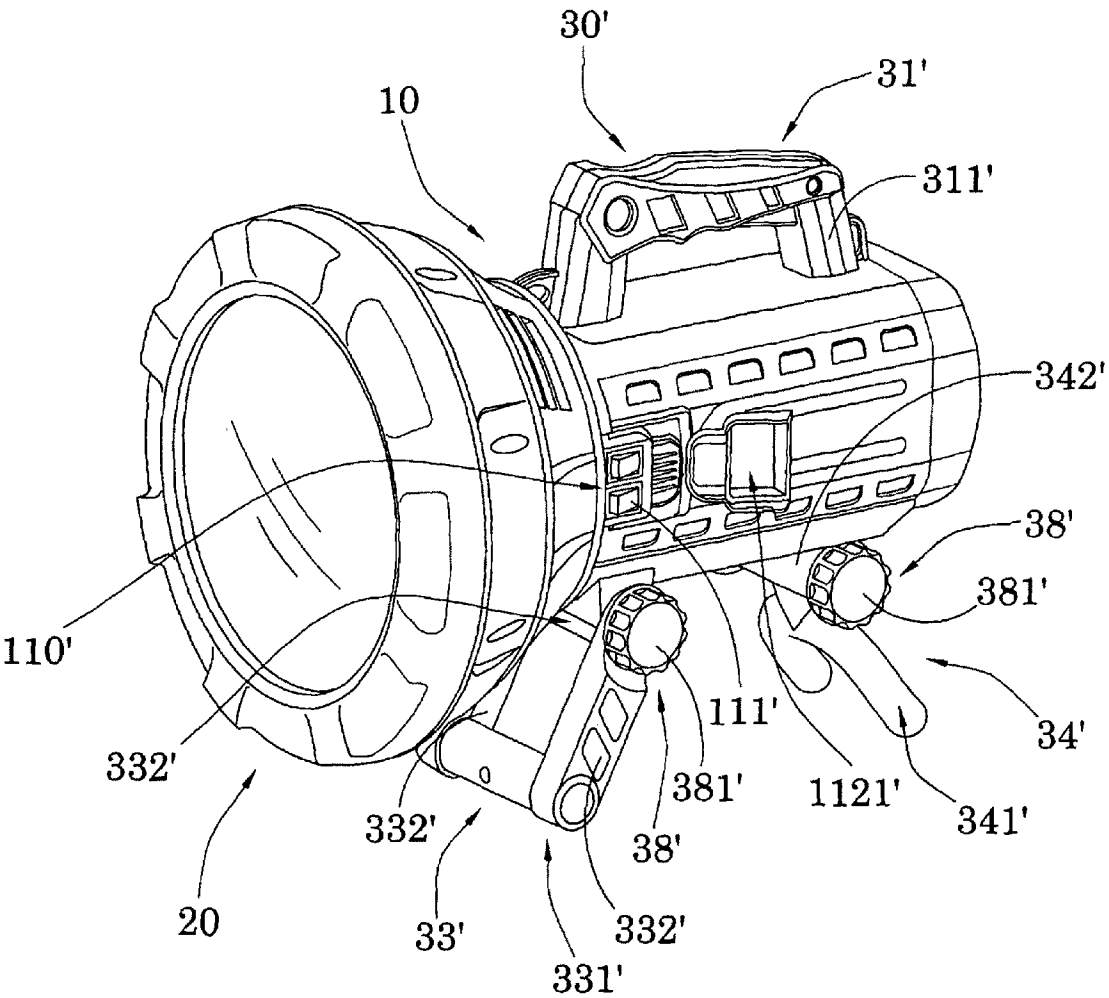
FIG. 7A to FIG. 7C are schematic diagrams illustrating the first alternative mode of the spot light according to the above preferred embodiment of the present invention.
Figure 7B:
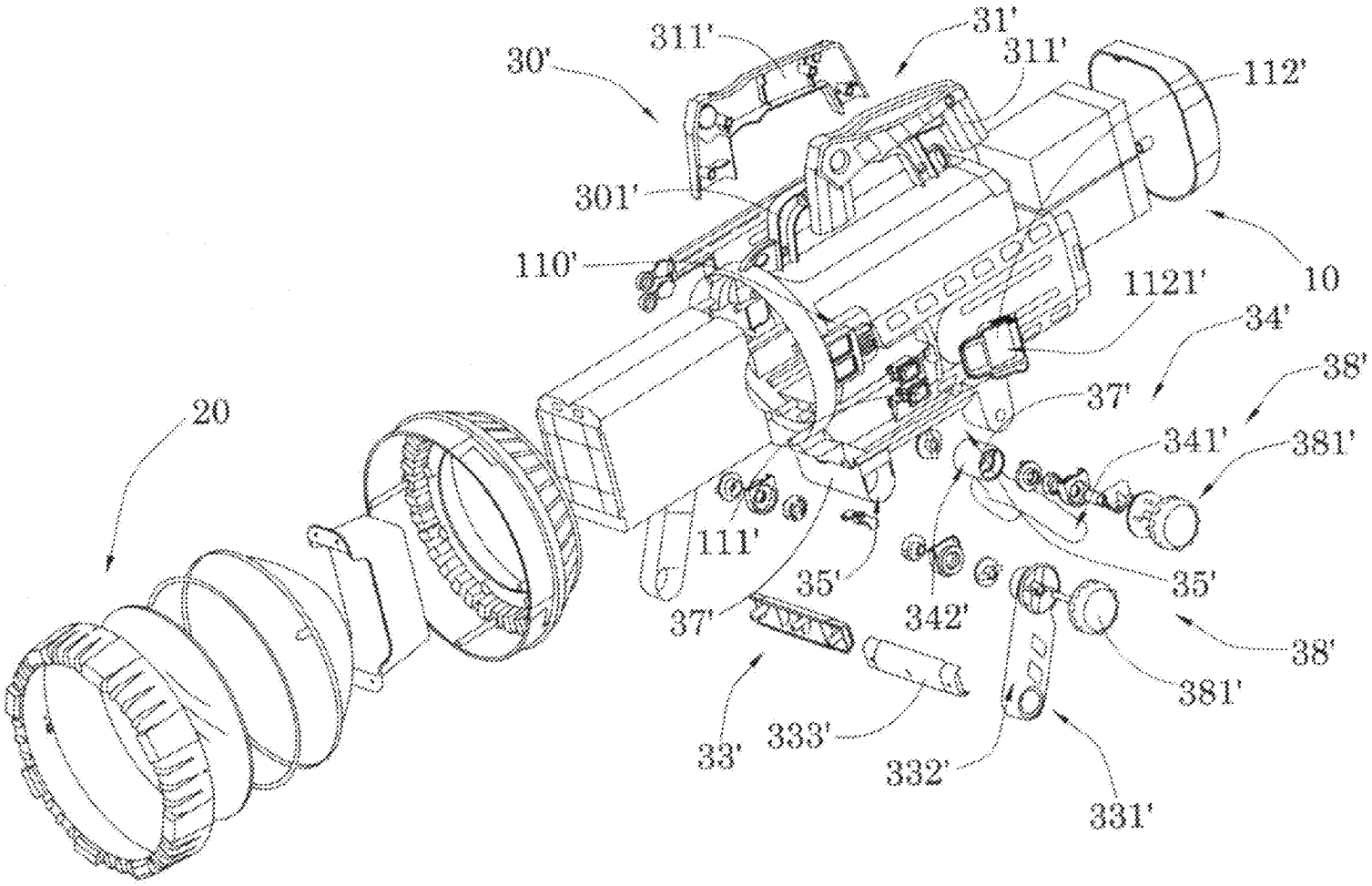
Figure 7C:
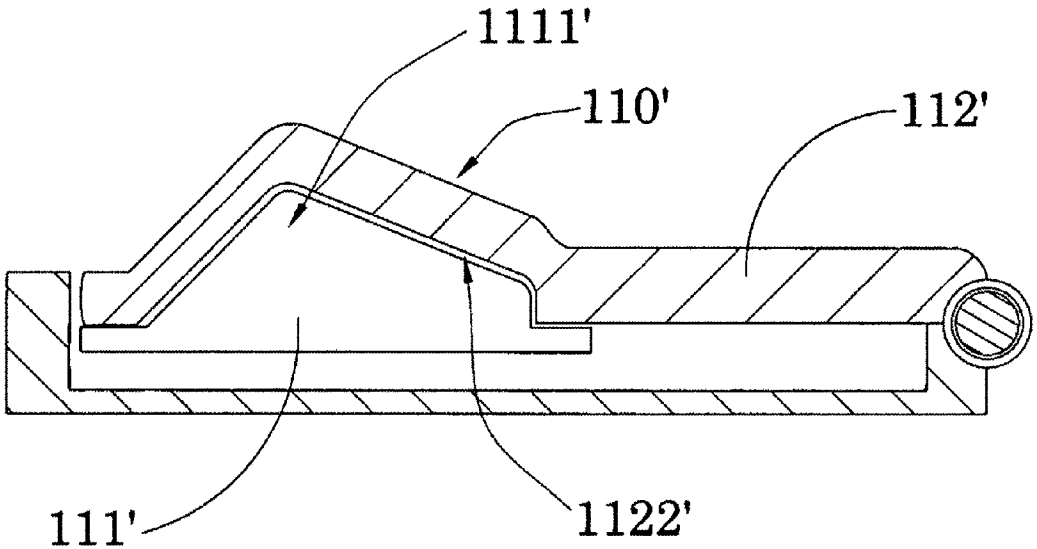

Moreover, as shown in FIG. 7A to FIG. 7C of the drawings, the main body 11 further comprises an operation switch 110' provided thereon, wherein the operation switch 110' is electrically connected with the light arrangement 20 so that a user is able to conveniently control the operation of the light arrangement 20 through actuation of the operation switch 110'.

Moreover, as shown in FIG. 7A and FIG. 7B of the drawings, the spot light accessory 30' further comprises a U-shaped front leg frame 33' and a U-shaped rear leg frame 34' as the accessory elements, wherein the front leg frame 33' and the rear leg frame 34' are pivotally coupling at front and rear portions of the main body 11 at a bottom side thereof respectively, such that the universal body 10 with the front and rear leg frames 33', 34' form a floor stand spot light.

The spot light accessory 30 has two spaced apart pivot slots 35' integrally and longitudinally pre-formed at the bottom side of the main body 11 to pivotally couple with the front and rear leg frames 33', 34' respectively. Accordingly, the spot light accessory 30' comprises two tubular members 37' spacedly and longitudinally provided at the bottom side of the main body 11 at front and rear portions thereof respectively, wherein the pivot slots 35' are defined within the tubular members 37' respectively. The spot light accessory 30' further comprises two axis lockers 38' for detachably locking the front and rear leg frames 33', 34' at the tubular members 37' in a pivotally movable manner.

In this first alternative mode, each of the front and the rear leg frames 33', 34' has a lower leg portion 331' (341') and an upper connecting portion 332' (342') extended from the respective lower leg portion 331' (341'), wherein the tubular member 37' and the pivot slot 35' of each of the front and the rear leg frames 33', 34' are formed at the respective upper connecting portion 332' (342') for pivotally and detachably connecting with the main body 11.

As shown in FIG. 7A and FIG. 7C of the drawings, the geometrical construction of each of the front and the leg frames 33', 34' may be different for providing different mechanical functions. For example, the lower leg portion 331' of the front leg frame 33' may comprise two side leg members 332' having upper ends coupled with the respective pivot slot 35', and a transverse leg member 333' connecting two lower end portions of the two side leg members 332' respectively so that the upper and the lower leg portion 331', 341' of the front leg frame 33' form a substantially quadrilateral cross section. On the other hand, the lower leg portion 341' of the rear leg frame 34' may be sized and shaped to have an inverted and integral U-shape cross section for providing two-point support of a rear portion of the main casing 11. The different construction of the front and the rear leg frame 33', 34' allow the user to optimally utilize the spot light of the present invention in different circumstances.

Accordingly, the axis lockers 38' are slidably and rotatably disposed within the pivot slots 35' respectively, wherein the front and rear leg frames 33', 34' are pivotally locked at the axis lockers 38' at the ends thereof such that the front and rear leg frames 33', 34 are adapted to pivotally fold between a folded position and an unfolded position. Each of the axis lockers 38' comprises locker knob 381' extended from the upper connecting portion 332' (342') of the corresponding front or rear leg frame 33' (34') for allowing a user to selectively lock up a position of that corresponding front or rear leg frame 33' (34).

Moreover, the operation switch 110' comprises a switch button 111' and a switching cover 112' movably attached to the universal body 10 in such a manner that when the switching cover 112' is moved to cover the switch button 111', the switch button 111' is driven to move at a predetermined status for operating the spot light. More specifically, the switching cover 112' forms a hollow structure having a receiving cavity 1121' formed therein, wherein a sidewall 1122' of the receiving cavity 1121' is slanted at a predetermined inclination such that when then switching cover 112' is moved to cover the switch button 111', the slanted sidewall 1122' is arranged to bias against a protruded portion 1111' of the switch button 111' so as to drive the switch button 111' to move from one status position to another status position. According to this first alternative mode of the present invention, when the switching cover 112' is moved to cover the switch button 111', the switch button 111' is moved from an opened position to a closed position. However, the arrangement of the switch button 111' can be such that when the switching cover 112' is moved to cover the switch button 111', the switch button 111' is arranged to move from the closed position to the opened position.

In other words, the switch button 111' has a substantially triangular cross section so that a height of one end portion of the switch button 111' is greater than that of the other end portion. When the switching cover 112' is moved to cover the switch button 111', the end portion having the greater height is then biased by the corresponding slanted portion of the switching cover 112' so as to be driven to move from one status position to another status position.

Referring to FIG. 8A to FIG. 8E of the drawings, a second alternative mode of the spot light according to the preferred embodiment of the present invention is illustrated. The second alternative mode is similar to the preferred embodiment, except the spot light accessory 30". According to the second alternative mode, the spot light accessory comprises an attachment member 301" having one end integrally connected with the main body 11, and another end suspendedly extended therefrom for coupling with a wide variety of handle members 31" as one of the accessory elements coupled with the main body 11. The attachment member 301" can be shaped and size to correspond with the shape and size of the corresponding handle member 31". For example, when the handle member 31", which may be manufactured as two handle frames 311", is shaped and sized to have a curved cross section, the attachment member 301" can also be shaped and sized to have a corresponding curved cross section so that the handle frames 311" are arranged to be detachably attached to two sides of the attachment member 301" for forming an optimal handle member 31" on the spot light as one of the spot light accessories 30". Thus, the attachment member 301" has one end integrally connected to the main body 11 for forming the curved cross section.

It is worth mentioning that the operation switch 110" can be provided on the handle member 31" instead of the main body 11 so as to allow convenient operation of the operation switch 110" when the user is grabbing on the handle member 31". In other words, the position of the operation switch 110" is ergonomically positioned on the handle member 31" so as to facilitate convenient and single-handed operation of the present invention.

Figure 8A:
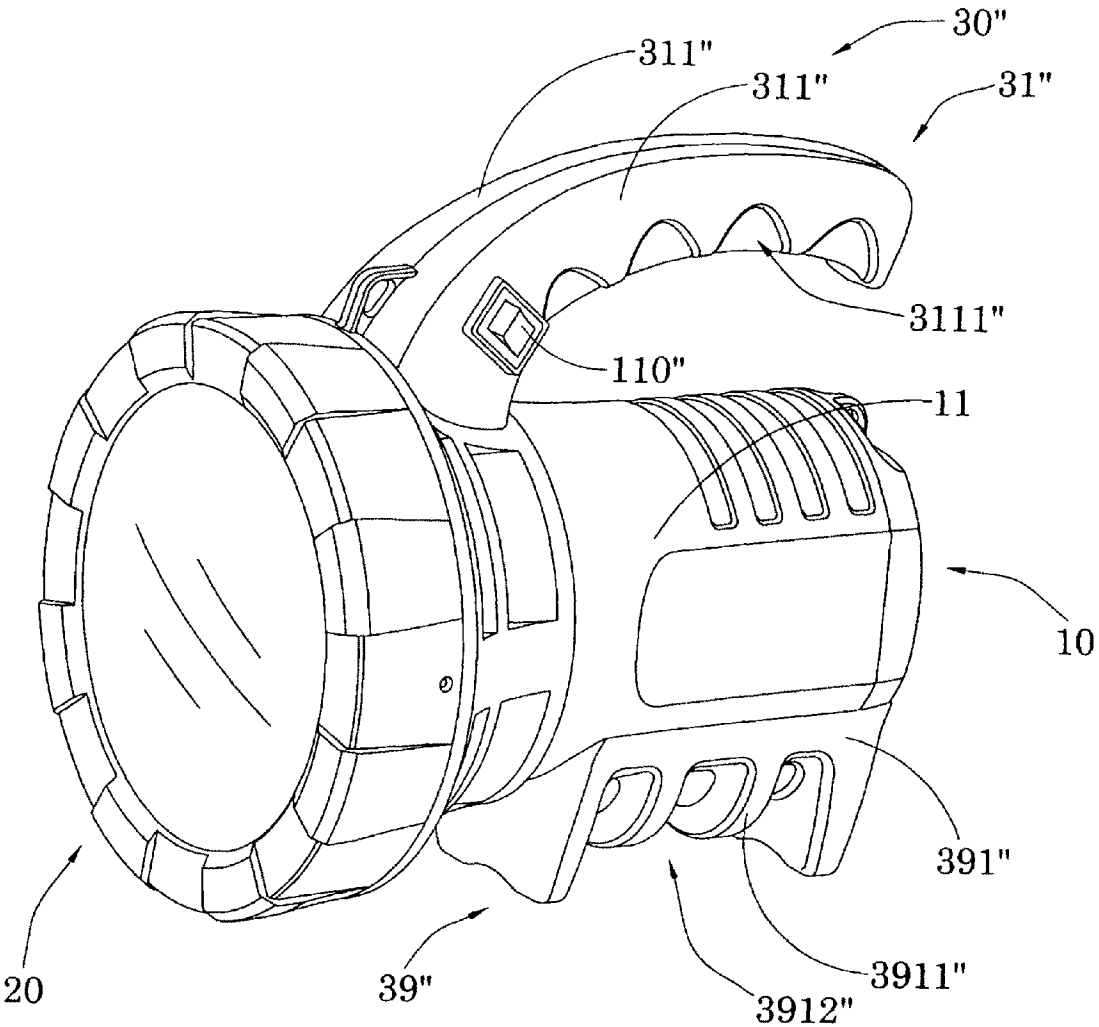
FIG. 8A to FIG. 8E illustrate a second alternative mode of the spot light according to the above preferred embodiment of the present invention.
Figure 8B:
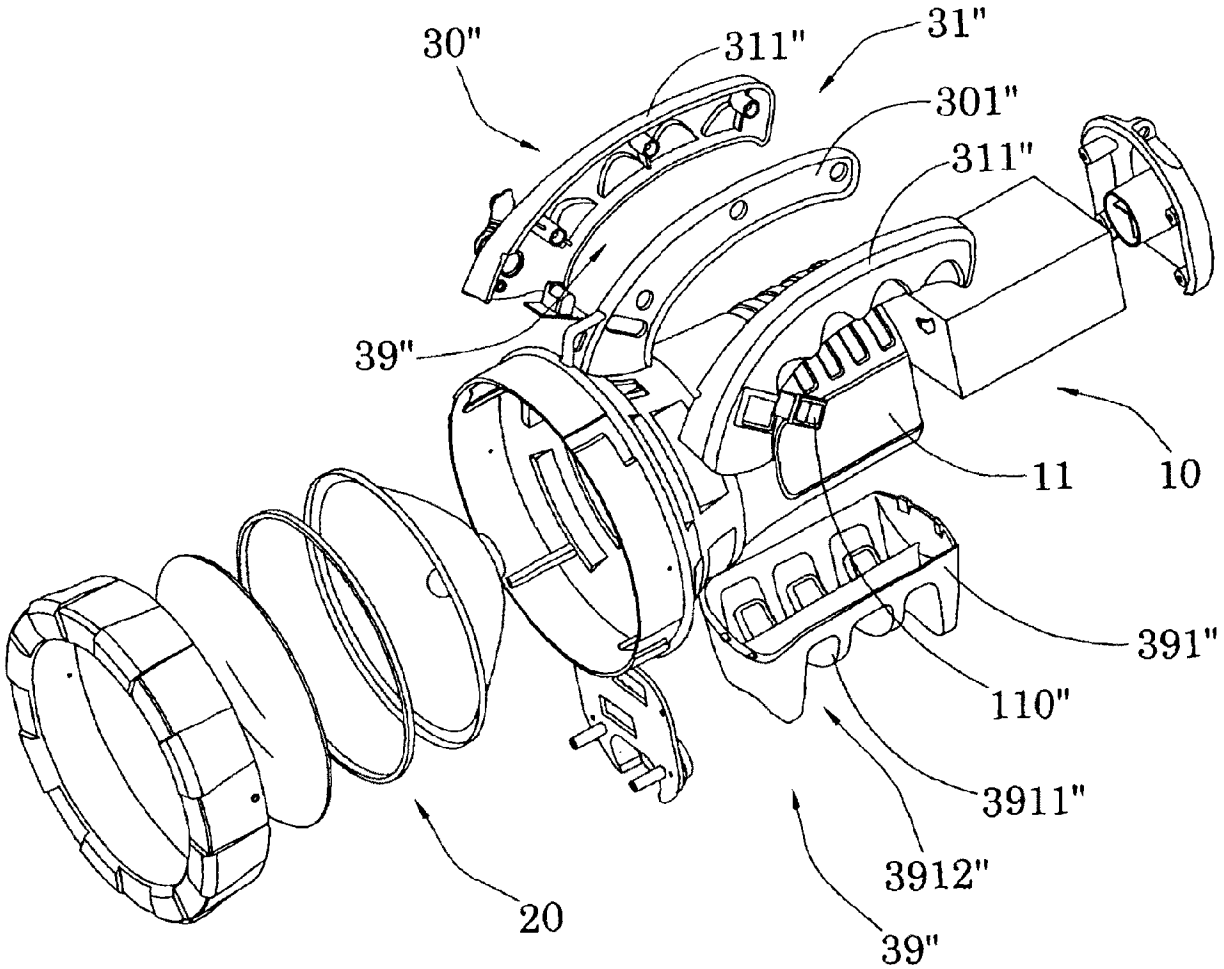
Figure 8C:
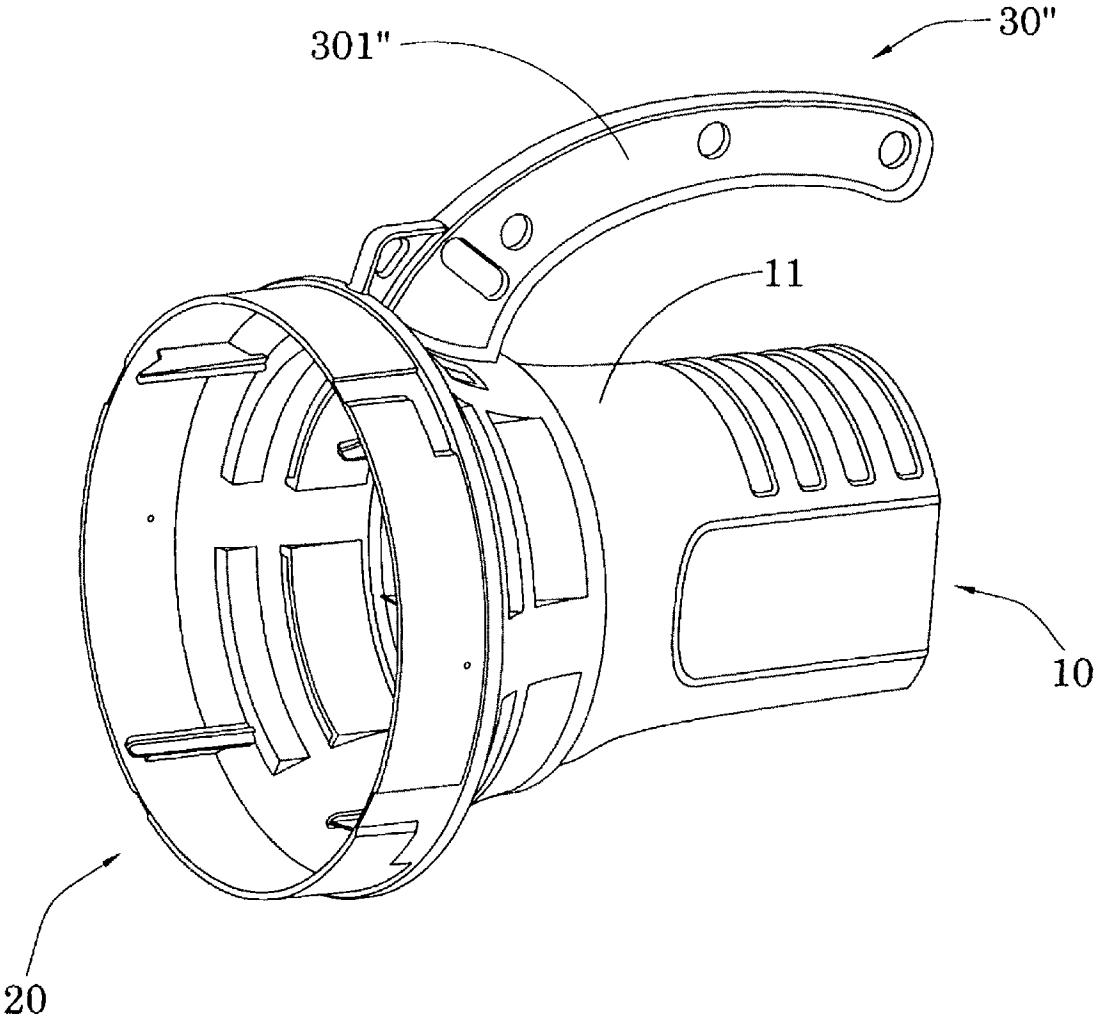
Figure 8D:
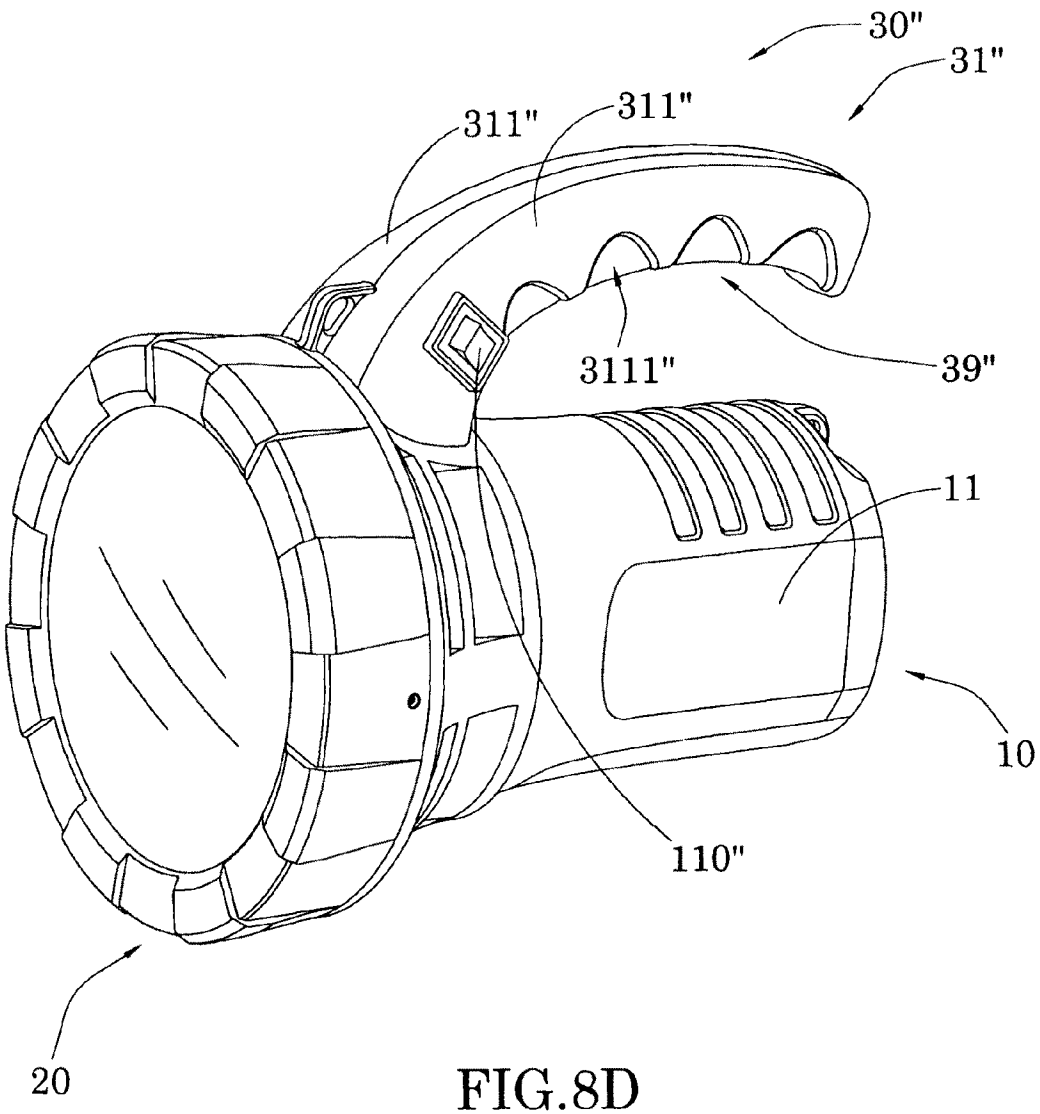
Figure 8E:
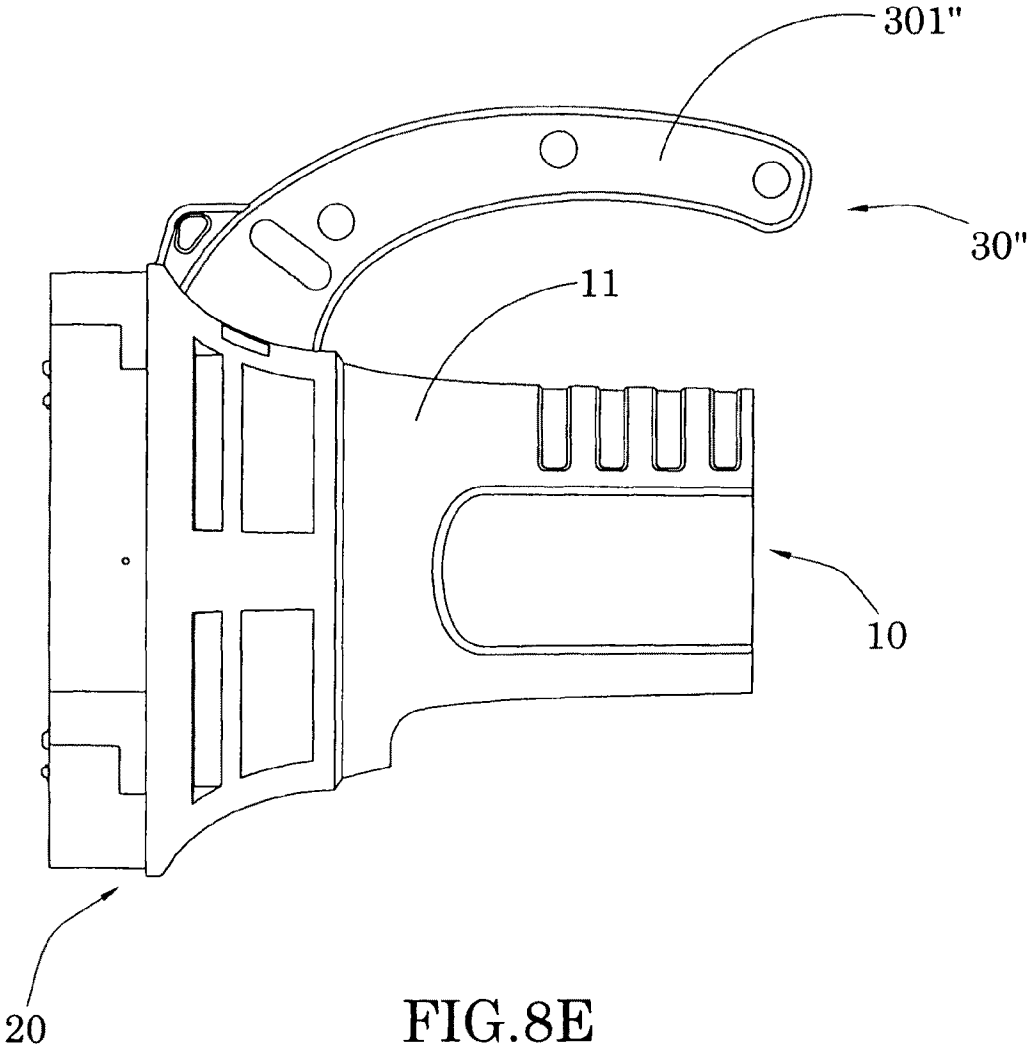

Moreover, the spot light accessory 30" further comprises a secure holding arrangement 39" provided on the main body 11 for allowing a user to securely hold the spot light with ease. More specifically, the secure holding arrangement 39" comprises a holder 391" detachably provided at the main body 11, wherein the holder 391" has a plurality of dividers 3911" spacedly formed thereon to divide the holder 391" into a corresponding number of finger compartments 3912" along a longitudinal direction of the holder 391", wherein the finger compartments 3912" is shaped and sized to fittedly receive predetermined fingers of the user so as to allow the user to put his or her specific fingers into the finger compartments 3912" for securely holding the spot light of the present invention. Referring to FIG. 8A and FIG. 8B of the drawings, the holder 391" is designed to accommodate three fingers of the users, yet in other situations, the number of finger compartments 3912" may be increased or decreased for fitting different needs.

It is worth mentioning that the handle member 31" and the secure holding arrangement 39" is meant to be selectively provided on the main body 11 for optimal application of the spot light of the present invention. The user or the manufacturer of the present invention is expected to selectively pick which particular spot light accessory 30" is to be incorporated on the main body 11 for their own purpose.

Furthermore, each of the handle frames 311" further has a plurality of grip compartments 3111" indently formed thereon so that when the handle frames 311" are detachably attached onto the attachment member 301", the grip compartments 3111" of one of the handle frames 311" are align with that of the corresponding handle frame 311" so as to accommodate specific fingers of the user.

Figure 9:
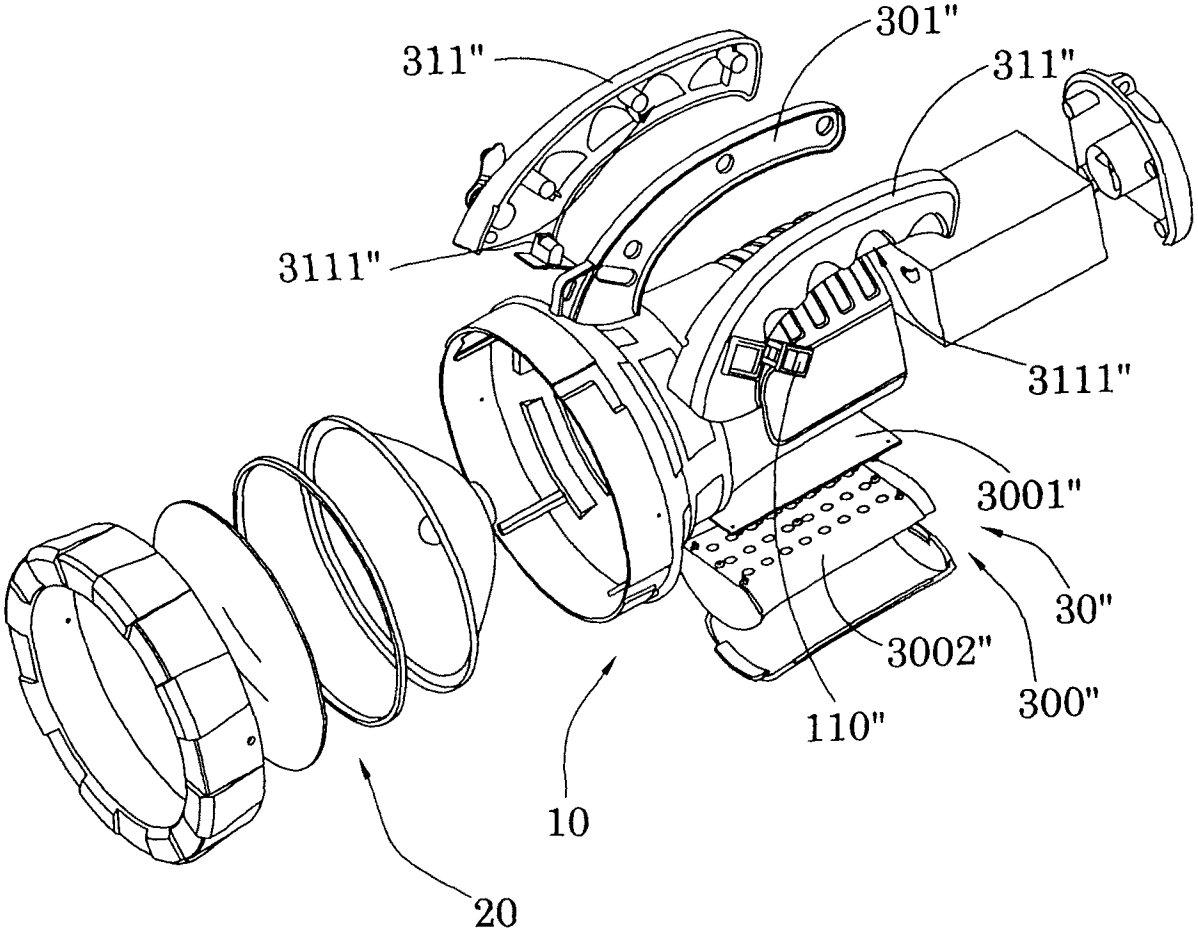
FIG. 9 is a third alternative mode of the spot light according to the above preferred embodiment of the present invention.

Referring to FIG. 9 of the drawings, a third alternative mode of the sport light according to the preferred embodiment of the present invention is illustrated. The third alternative mode is similar to the second alternative mode, except the spot light accessory 30". According to the third alternative mode, the spot light accessory 30" comprises a gripping pad 300" detachably provided on the main body 11, wherein the gripping pad 300" is arranged to provide high frictional force for allowing a user to grip on the main body without slipping. In this third alternative mode, the gripping pad 300" comprises a base member 3001" detachably attached to the main body 11 and a plurality of frictional members 3002" extended from the base member 3001", wherein each of the frictional members 3002" possess a predetermined amount of frictional force such that when a user grips on the gripping pad 300", the frictional force prevents the user's hand from slipping on the main body 11.

Figure 10:
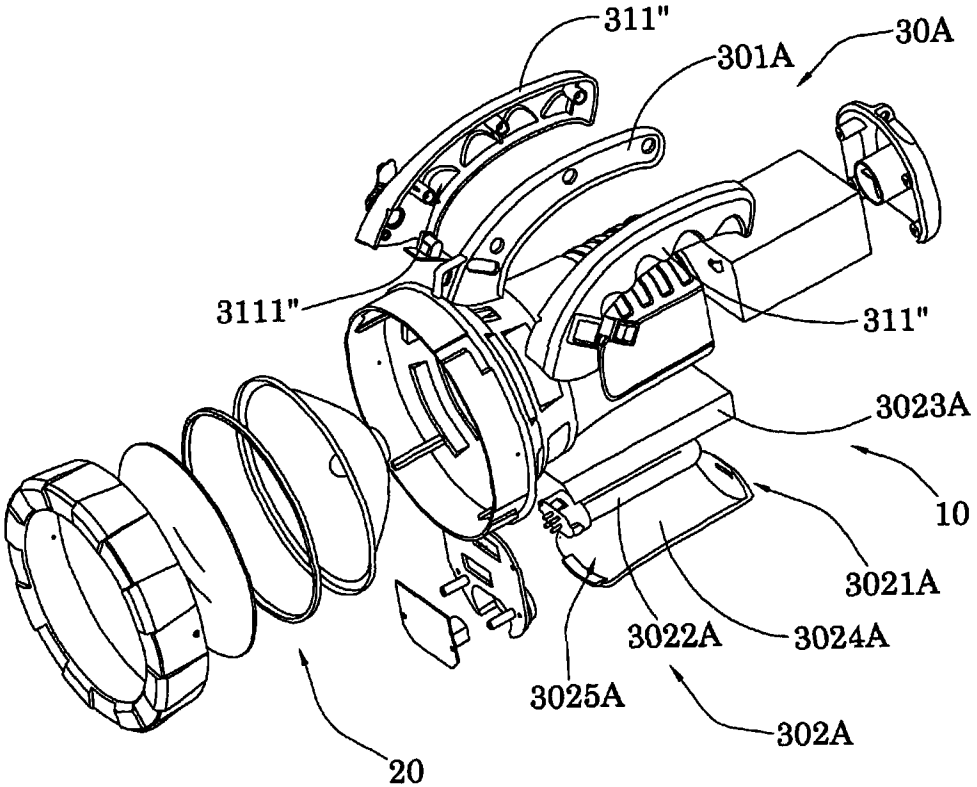
FIG. 10 is a fourth alternative mode of the spot light according to the above preferred embodiment of the present invention.

Referring to FIG. 10 of the drawings, a fourth alternative mode of the sport light according to the preferred embodiment of the present invention is illustrated. The fourth alternative mode is similar to the second alternative mode, except the spot light accessory 30A. In this fourth alternative mode, the spot light accessory 30A includes the handle member 30A and the attachment member 301A which are identical to the handle member 30' and the attachment member 301' referred to in the first alternative mode above.

Furthermore, the spot light accessory 30A further comprises an auxiliary lighting arrangement 302A which comprises a light holder 3021A provided on the main casing 11 at an opposed side of the handle member 31A, and a secondary light source 3022A received in the light holder 3021A for providing an additional source of illumination apart from the illuminating unit 22 described above. More specifically, the light holder 3021A comprises a base holder 3023A mounted on the main casing 11 and a light admissible cover 3024A mounted on the base holder 3023A to form a secondary lighting cavity 3025A, wherein the secondary light source 3022A is received in the lighting cavity 3025A to electrically connect with the existing electrical unit 21 provided on the spot light (as described above).

In this fourth alternative mode, the secondary light source 3022A is preferably embodied as a elongated florescent lamp for providing different kind of illumination as compared with the illuminating unit 22 disclosed above. However, any kinds of light source can also be used as the secondary light source 3022A in order to accommodate different circumstances in which the present invention is utilized.

Figure 11:
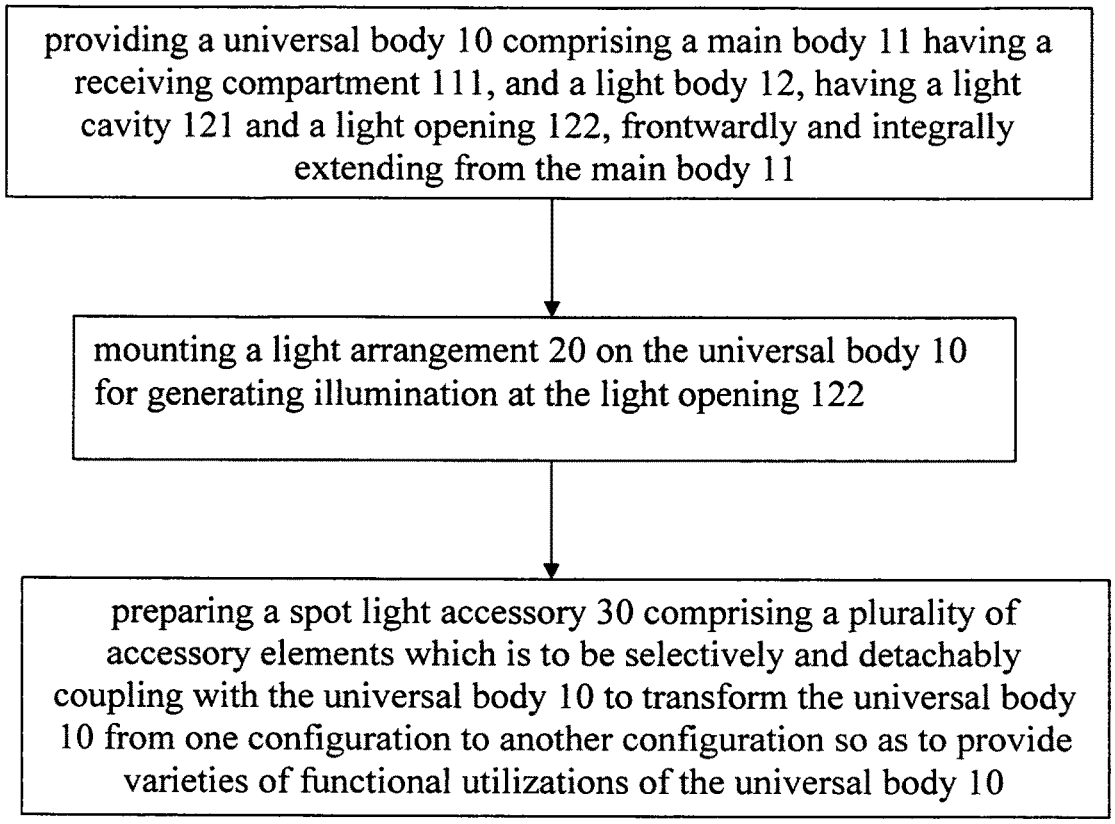
FIG. 11 is a method of manufacturing a spot according to the preferred embodiment of the present invention.

As shown in FIG. 11 of the drawings, in light of the above description, the present invention provides a method of manufacturing a spot light, which comprises the steps of:

(a) providing a universal body 10 comprising a main body 11 having a receiving compartment 111, and a light body 12, having a light cavity 121 and a light opening 122, frontwardly and integrally extending from the main body 11;

(b) mounting a light arrangement 20 on the universal body 10 for generating illumination at the light opening 122; and (c) preparing a spot light accessory 30 comprising a plurality of accessory elements which is to be selectively and detachably coupling with the universal body 10 to transform the universal body 10 from one configuration to another configuration so as to provide varieties of functional utilizations of the universal body 10.

Note that the spot light accessory 30 can take many different forms. The steps for manufacturing the spot light according to the above mentioned alternatives are summarized as follows.

In the first and the second alternative modes, step (c) comprises the steps of:

(c.1) providing a plurality of handle members 31' each having a predetermined cross section and comprises two handle frames 311';

(c.2) forming an attachment member 301' extended from the main body 11 for detachably coupling with the handle members 31' as one of the accessory elements; and (c.3) detachably coupling the handle frames 311' at two sides of the attachment member 301' respectively for forming the respective handle member 31.

For assembling of leg frames, step (c) further comprises the steps of:

(c.4) forming a front leg frame 33' and a rear leg frame 34' as the accessory elements; and (c.5) pivotally and detachably coupling the front leg frame 33' and the rear leg frame 34' at front and rear portions of the main body 11 at a bottom side thereof respectively, such that the universal body 10 with the front and rear leg frames 33', 34' form a floor stand spot light.

The difference between the first and the second alternative mode is the cross sectional shapes of the attachment member 301' (301") and the handle member 31' (31"). Moreover, step (c) further comprises the step (c.6) of forming the secure holding arrangement 39" on the main body 11 for allowing a user to securely hold the spot light with ease.

For the third alternative mode, step (c) comprises the steps of:

(c.1") forming a gripping pad 300" having a high frictional ability; and (c.2") detachably attaching the gripping pad 300" on the main body 11 for providing high frictional force to allow a user to grip on the main body without slipping.

In the fourth alternative mode, step (c) comprises the steps of:

(c.1.1) forming an auxiliary lighting arrangement 302A; and (c.1.2) detachably attaching the auxiliary lighting arrangement onto the light body 11 for providing an additional source of illumination apart from the illuminating unit 22.

Note that the combination of any particular spot light accessory is within the scope of the present invention. A user or a manufacturer of the present invention is free to manufacture or use any particular spot light accessory at will. The exact combination would depend on the circumstances in which the present invention is marketed or utilized.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A portable light assembly, comprising:

a universal body comprising a main body and a light body, wherein said main body has a receiving compartment, wherein said light body has a light cavity and a front light opening, wherein said light body is frontwardly and integrally extending from said main body;

a light arrangement supported by said universal body for generating illumination at said light opening; and a spot light accessory for selectively and detachably coupling with said universal body to transform said universal body from to one configuration to another configuration so as to provide varieties of functional utilizations of said universal body, wherein said spot light accessory comprises:

a first accessory element set selectively and detachably coupling at a top side of said universal body, wherein said first accessory element set comprises an attachment member integrally extended from said main body and different handle frames, wherein one of said handle frames is selectively coupled to said attachment member; and a second accessory element set selectively and detachably coupling at a bottom side of said universal body, wherein said second accessory element set comprises different floor stands, a secure holding arrangement for allowing a user to securely hold said spot light, a gripping pad, and an auxiliary lighting arrangement, wherein said floor stands, said secure holding arrangement, said gripping pad, and said auxiliary light arrangement are interchangeable that one of said floor stands, said secure holding arrangement, said gripping pad, and said auxiliary light arrangement is selectively coupled to said bottom side of said universal body to transform said universal body from one configuration to another configuration so as to provide varieties of functional utilizations of said universal body; and an operation switch which comprises a switch button connected with said light arrangement and a switching cover movably coupled at said universal body, wherein when said switching cover is moved to cover said switch button, said switch button is driven to move from one status position to another status position, wherein said switching cover has a hollow structure to define a receiving cavity therein, wherein a sidewall of said receiving cavity is slanted at a predetermined inclination such that when said switching cover is moved to cover said switch button, said slanted sidewall is biased against a protruded portion of said switch button to move said switch button from one status position to another status position, wherein a first floor stand comprises a U-shaped front leg frame and a U-shaped rear leg frame pivotally and detachably coupled at front and rear portions of said main body at said bottom side thereof respectively, wherein said front leg frame has a receiving cavity having a size larger than a size of said rear leg frame, wherein when said front and rear leg frames are pivotally folded frontwardly and rearwardly, said front and rear leg frames forms a stand for supporting said main body, wherein after said rear leg frame is pivotally and frontwardly folded on said bottom side of said main body, said front leg frame is pivotally and rearwardly folded to enclose said rear leg frame within said receiving cavity.

2. The portable light assembly, as recited in claim 1, wherein a second floor stand comprises a U-shaped front leg frame and an inverted U-shaped rear leg frame pivotally and detachably coupled at front and rear portions of said main body at said bottom side thereof respectively, wherein the shape of said front leg frame is different from the shape of said rear leg frame, wherein said front leg frame has a transverse leg member at a lower leg portion to support said front portion of said main body, wherein said rear leg frame provides a two-support at said rear portion of said main body.

3. The portable light assembly, as recited in claim 2, wherein said secure holding arrangement comprises a holder detachably provided at said main body, wherein said holder has a plurality of dividers spacedly formed thereon to divide said holder into a corresponding number of finger compartments along a longitudinal direction of said holder, wherein said finger compartments is shaped and sized to fittedly receive predetermined fingers of said user so as to allow said user to put specific fingers into said finger compartments for securely holding said main body.

4. The portable light assembly, as recited in claim 3, wherein said gripping pad is detachably coupled on said bottom side of said main body, wherein said gripping pad is arranged to provide high frictional force for allowing said user to grip on said main body without slipping.

5. The portable light assembly, as recited in claim 4, wherein said auxiliary lighting arrangement comprises a light holder provided on said main body at an opposed side of said handle member, and a secondary light source received in said light holder for providing an additional source of illumination apart from said light arrangement, wherein said light holder comprises a base holder mounted on said main body and a light admissible cover mounted on said base holder to form a secondary lighting cavity, wherein said secondary light source is received in said secondary lighting cavity for providing illumination.

6. A method of manufacturing a portable light assembly, comprising the steps of:

(a) providing a universal body comprising a main body and a light body, wherein said main body has a receiving compartment, wherein said light body has a light cavity and a front light opening, wherein said light body is frontwardly and integrally extending from said main body, wherein an attachment member is integrally extended from said main body;

(b) mounting a light arrangement on said universal body for generating illumination at said light opening;

(c) preparing a first accessory element set for selectively and detachably coupling at a top side of said universal body, wherein said first accessory element set comprises different handle frames, wherein one of said handle frames is selectively coupled to said attachment member;

(d) preparing a second accessory element set for selectively and detachably coupling at a bottom side of said universal body, wherein said second accessory element set comprises different floor stands, a secure holding arrangement for allowing a user to securely hold said spot light, a gripping pad, and an auxiliary lighting arrangement, wherein said floor stands, said secure holding arrangement, said gripping pad, and said auxiliary light arrangement are interchangeable; and (e) selectively coupling one in said first accessory element set at said top side of said universal body and selectively coupling one in said second accessory element set at said bottom side of said universal body to transform said universal body from one configuration to another configuration so as to provide varieties of functional utilizations of said universal body wherein the step (b) further comprises the steps of (b.1) connecting a switch button with said light arrangement; and (b.2) movably coupling a switching cover at said universal body, wherein when said switching cover is moved to cover said switch button, said switch button is driven to moved from one status position to another status position, wherein, in the step (b.2), said switching cover has a hollow structure to define a receiving cavity therein, wherein a sidewall of said receiving cavity is slanted at a predetermined inclination such that when said switching cover is moved to cover said switch button, said slanted sidewall is biased against a protruded portion of said switch button to move said switch button from one status position to another status position, wherein the step (e) further comprises a step of selecting a first floor stand to couple at said bottom side of said main body, wherein said first floor stand comprises a U-shaped front leg frame and a U-shaped rear leg frame pivotally and detachably coupled at front and rear portions of said main body at said bottom side thereof respectively, wherein said front leg frame has a receiving cavity having a size larger than a size of said rear leg frame, wherein when said front and rear leg frames are pivotally folded frontwardly and rearwardly, said front and rear leg frames forms a stand for supporting said main body, wherein after said rear leg frame is pivotally and frontwardly folded on said bottom side of said main body, said front leg frame is pivotally and rearwardly folded to enclose said rear leg frame within said receiving cavity.

7. A portable light assembly, comprising:

a universal body comprising a main body and a light body, wherein said main body has a receiving compartment, wherein said light body has a light cavity and a front light opening, wherein said light body is frontwardly and integrally extending from said main body;

a light arrangement supported by said universal body for generating illumination at said light opening; and a spot light accessory for selectively and detachably coupling with said universal body to transform said universal body from to one configuration to another configuration so as to provide varieties of functional utilizations of said universal body, wherein said spot light accessory comprises:

an accessory element set selectively and detachably coupling at a top side of said universal body, wherein said first accessory element set comprises an attachment member integrally extended from said main body and different handle frames, wherein one of said handle frames is selectively coupled to said attachment member; and a floor stand comprises a U-shaped front leg frame and a U-shaped rear leg frame pivotally and detachably coupled at front and rear portions of said main body at a bottom side thereof respectively, wherein said front leg frame has a receiving cavity having a size larger than a size of said rear leg frame, wherein when said front and rear leg frames are pivotally folded frontwardly and rearwardly, said front and rear leg frames forms a stand for supporting said main body, wherein after said rear leg frame is pivotally and frontwardly folded on said bottom side of said main body, said front leg frame is pivotally and rearwardly folded to enclose said rear leg frame within said receiving cavity.

8. The portable light assembly, as recited in claim 7, wherein said spot light accessory further comprises an operation switch which comprises a switch button connected with said light arrangement and a switching cover movably coupled at said universal body, wherein when said switching cover is moved to cover said switch button, said switch button is driven to move from one status position to another status position, wherein said switching cover has a hollow structure to define a receiving cavity therein, wherein a sidewall of said receiving cavity is slanted at a predetermined inclination such that when said switching cover is moved to cover said switch button, said slanted sidewall is biased against a protruded portion of said switch button to move said switch button from one status position to another status position.

9. The portable light assembly, as recited in claim 7, wherein said auxiliary lighting arrangement comprises a light holder provided on said main body at an opposed side of said handle member, and a secondary light source received in said light holder for providing an additional source of illumination apart from said light arrangement, wherein said light holder comprises a base holder mounted on said main body and a light admissible cover mounted on said base holder to form a secondary lighting cavity, wherein said secondary light source is received in said secondary lighting cavity for providing illumination.

* * * * *